US006041991A

United States Patent [19]

Mehri et al.

[11] Patent Number: 6,041,991

[45] Date of Patent: Mar. 28, 2000

[54] CABLE CONVEYING UNIT

[75] Inventors: Urs Mehri, Emmenbrücke; Claudio Meisser, Cham; Alois Lustenberger, Littau, all of Switzerland

[73] Assignee: Komax Holding AG, Dierikon, Switzerland

[21] Appl. No.: 09/035,748

[22] Filed: Mar. 6, 1998

[30] Foreign Application Priority Data

Mar. 10, 1997 [CH] Switzerland ..... 0564/97

[51] Int. Cl.[7] ..... B65H 20/00; B65H 20/24

[52] U.S. Cl. ..... 226/177; 226/110; 226/172; 226/187; 226/188

[58] Field of Search ..... 226/110, 43, 139, 226/143, 172, 176, 177, 187, 188

[56] References Cited

U.S. PATENT DOCUMENTS

| | | | |
|---|---|---|---|
| 1,798,316 | 3/1931 | Dreisbach | 226/176 X |
| 3,581,964 | 6/1971 | Betron | 226/43 X |
| 3,632,031 | 1/1972 | Gurner | 226/188 X |
| 3,669,329 | 6/1972 | Blanchet et al. | 226/177 X |
| 3,948,425 | 4/1976 | Bala | 226/43 |
| 4,033,496 | 7/1977 | Rolfe | 226/188 |
| 4,620,409 | 11/1986 | McElvy | 226/172 |
| 4,815,201 | 3/1989 | Harris | 226/187 X |
| 5,586,709 | 12/1996 | Del Fabro et al. | 226/177 |
| 5,752,642 | 5/1998 | Bucher | 226/110 X |

FOREIGN PATENT DOCUMENTS 3138820 4/1983 Germany .

*Primary Examiner*—Michael R. Mansen
*Attorney, Agent, or Firm*—Pillsbury Madison & Sutro

[57] ABSTRACT

This cable conveying unit serves for the precise feeding of a given length of a cable into a cable processing station between at least two conveying rollers or bands driven in counterrotation and capable of being placed against the outside of such a cable.

For this purpose the two conveying rollers or bands disposed on either side of the cable passing through and each associated with a drive unit are driven, mechanically separated from one another in terms of drive, by a respective speed-controlled electric motor.

10 Claims, 7 Drawing Sheets

CABLE CONVEYING UNIT

BACKGROUND OF THE INVENTION

1. Field of the Invention

The present invention relates to a cable conveying unit for the precise feeding of a given length of a cable into a cable processing station between at least two conveying rollers or bands driven in counterrotation and capable of being placed against the outside of such a cable.

2. Description of the Prior Art

In the automatic cable processing machines known to date, the cable feeding is effected by means of double roller or double band drive, the precisely synchronous, counterrotating drive of the two mutually opposite cable conveying roller or bands each associated with a drive unit by toothed wheel or toothed belt deflection mechanisms being relatively complex on account of the required adjustability of the distance between the two cable driving rollers or bands or their drive units. If between these latter there is additionally disposed a cable changer displaceable perpendicularly to the direction of the cable passing through, the degree of complexity of deflecting the drive from the one conveying roller or conveying band about the clearance required for the displaceability of the cable changer and as far as the second cable conveying roller situated on the other side of the displaceable cable changer, or the second cable conveying band, becomes extremely great, and the large inert masses, which result in this case, of the drive connections required to do this additionally make it exceptionally difficult to achieve a quick and nevertheless precise go and stop operation.

SUMMARY OF THE INVENTION

It is the object of the present invention to provide a cable conveying unit which does not have these disadvantages of the above-mentioned cable conveying units known to date, that is to say which no longer requires a mechanical drive connection between the two drive units disposed on either side of the cable passing through.

This object is achieved in accordance with the invention by means of a cable conveying unit.

Expedient developments of the cable conveying unit according to the invention are the subject of the dependent claims.

BRIEF DESCRIPTION OF THE DRAWINGS

The invention is explained below by way of example with reference to the drawing, in which.

DESCRIPTION OF THE PREFERRED EMBODIMENTS

Figure 1:
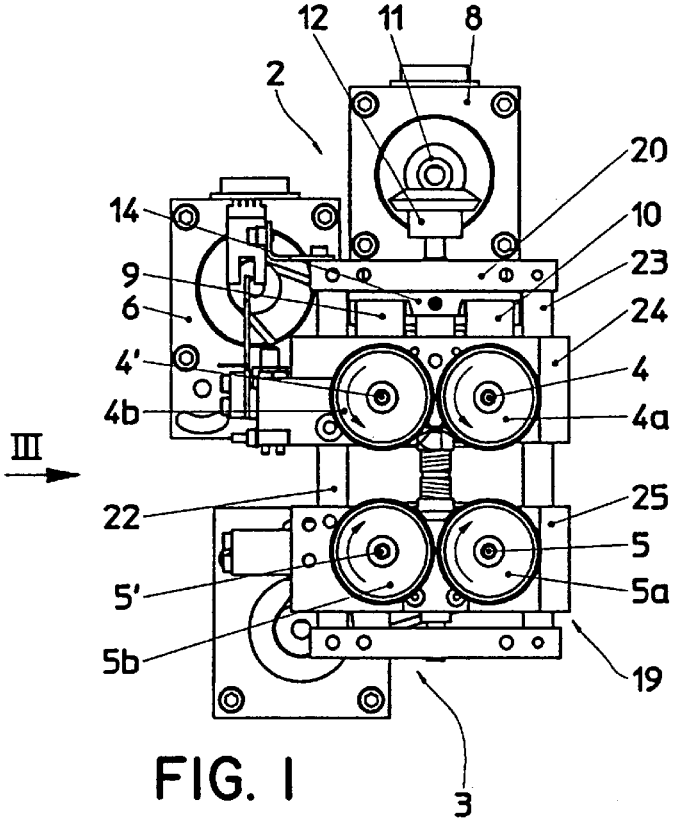
FIG. 1 shows a front view of a first exemplary embodiment of a cable conveying unit according to the invention.
Figure 2:
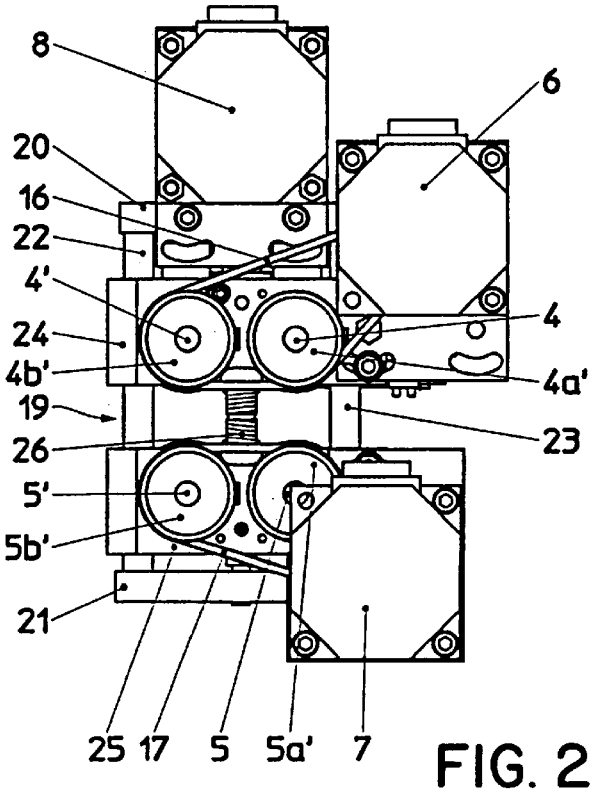
FIG. 2 shows a rear view of the cable conveying unit illustrated in FIG. 1.
Figure 3:
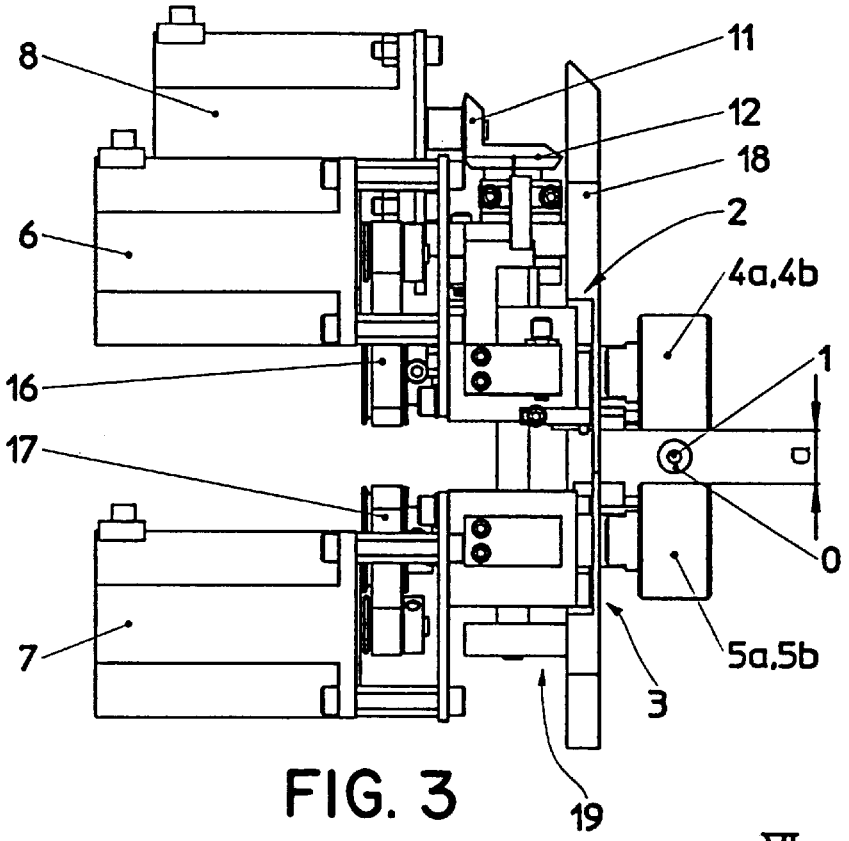
FIG. 3 shows a side view of the cable conveying unit illustrated in FIG. 1 in the direction of the arrow III in FIG. 1.
Figure 4:
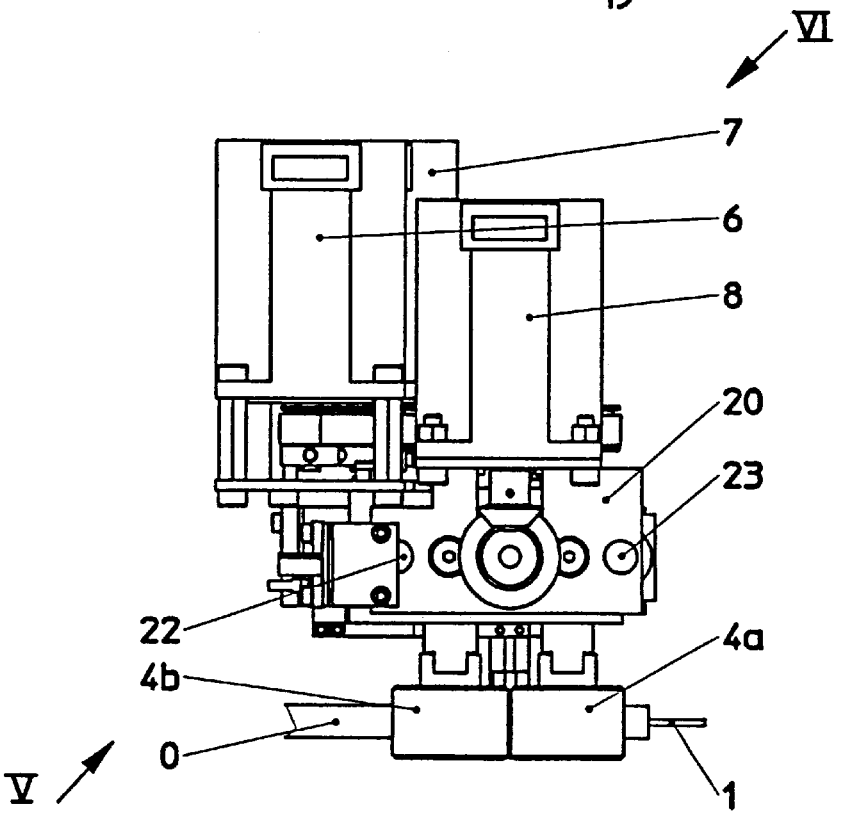
FIG. 4 shows a plan view of the cable conveying unit illustrated in FIG. 1.
Figure 5:
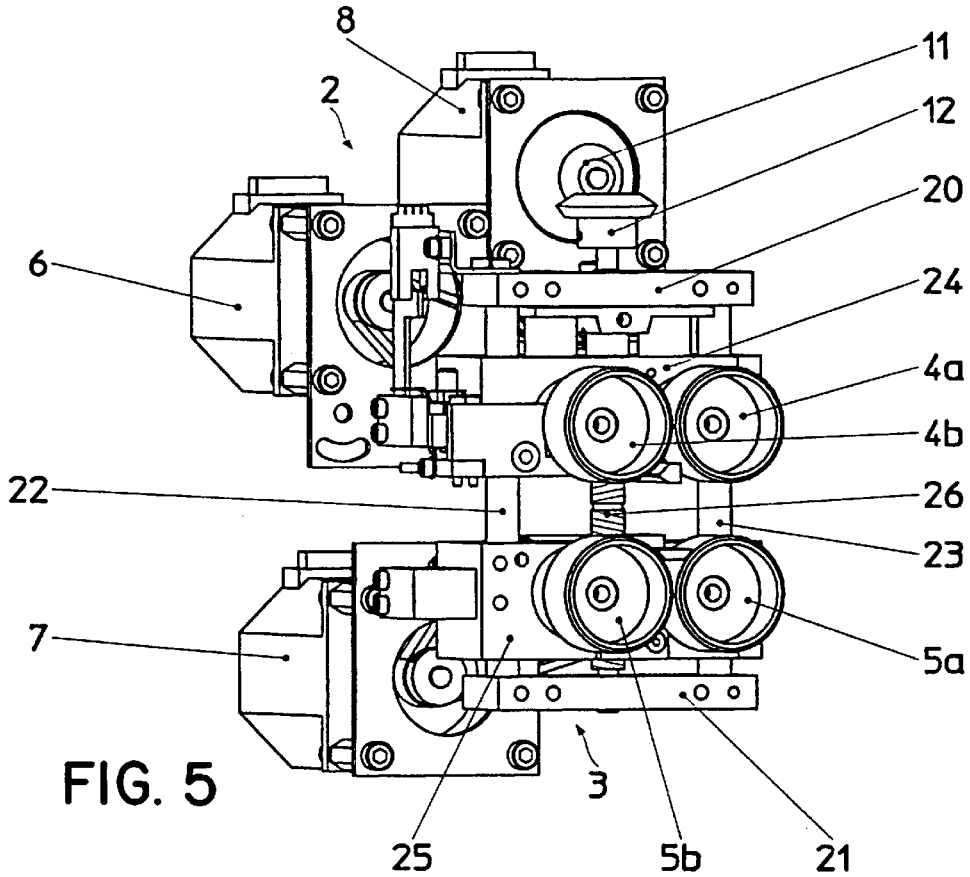
FIG. 5 shows a perspective view of the cable conveying unit illustrated in FIG. 1 as seen in the direction of the arrow V in FIG. 4.
Figure 6:
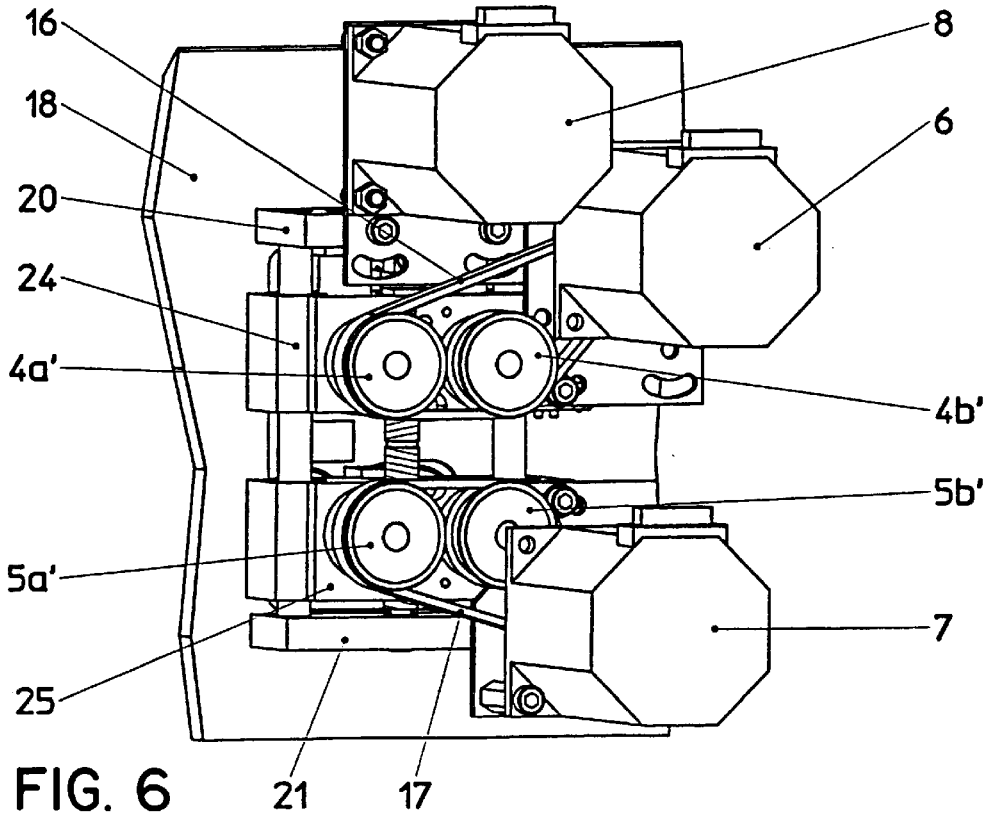
FIG. 6 shows a perspective view of the cable conveying unit illustrated in FIG. 1 as seen in the direction of the arrow VI in FIG. 4.

In all the figures of the drawing the same reference numerals are used for analogous parts, so that it is not necessary to describe analogous parts repeatedly.

The cable conveying unit according to the invention is suitable for conveying all types of cables, i.e. cables having metallic or glass conductors, optical waveguides, conductors with shielding etc., and also for limp cables, i.e. for very thin cables of low rigidity for example.

As is apparent from FIGS. 1 to 6, the cable conveying unit illustrated in these figures for the precise feeding of a given length of a cable or conductor 0 into a cable processing station (not shown) has two conveying roller pairs 4*a*, 4*b* and 5*a*, 5*b* driven in counterrotation and capable of being placed against the outside of such a cable 0 under a predetermined contact pressure.

The two conveying roller pairs 4*a*, 4*b* and 5*a*, 5*b* each associated on either side of the cable passing through 1 with a respective drive unit 2 and 3 are driven, mechanically completely separated from one another in terms of drive, by a respective speed-controlled electric motor 6 and 7, said electric motors rotating counter to one another for the feeding of the cable or conductor 0 to be conveyed. For this purpose the two conveying roller pairs 4*a*, 4*b* and 5*a*, 5*b* are connected in terms of drive to the respective associated electric motor 6 and 7 by a respective common drive belt 16 and 17 designed as a toothed belt (see FIG. 2).

The two electric motors 6 and 7 are reversible in their direction of rotation in order to effect a return movement of a cable or conductor 0 to be processed by a given amount from a previously effected feed position.

A fastening and guiding frame 19 serves to fasten the cable conveying unit to a fastening plate 18 (see FIG. 3), said frame being formed by an upper fastening support 20, a lower fastening support 21 and two vertical guides 22 and 23 extending between and fastened to said supports.

To adjust the mutual conveying roller distance a (see FIG. 3) between the conveying roller pairs 4*a*, 4*b* and 5*a*, 5*b*, the two drive units 2 and 3 are vertically displaceably guided by the vertical guides 22 and 23 with the aid of respective slide carriages 24 and 25.

The two slide carriages 24 and 25 serve for the rotatable mounting of two respective conveying rollers 4*a*, 4*b* and 5*a*, 5*b* and for the fastening of a respective conveying roller drive motor 6 and 7. The conveying rollers 4*a*, 4*b* and 5*a*, 5*b* are connected by a respective drive shaft 4, 4' and 5, 5' rotatably mounted in the respective slide carriage 24 and 25 to a respective toothed drive wheel 4*a*', 4*b*', 5*a*' and 5*b*' situated on the opposite side of the respective corresponding slide carriage 24 and 25, said toothed drive wheels being connected in terms of drive to the respective associated drive motors 6 and 7 by the respective toothed drive belts 16 and 17.

To move the two slide carriages 24 and 25 together and away from one another precisely and simultaneously, a counterrotating spindle 26 with left-hand and right-hand thread is, furthermore, rotatably mounted in the frame 19, said spindle being connected in terms of drive by a bevel gearing 11,12 to an adjusting motor 8, preferably designed as a stepping motor, which is fastened to the upper fastening support 20.

The lower slide carriage 25 is in positive engagement with the lower part of the spindle 26 provided with the left-hand and right-hand thread. The upper slide carriage 24 is resiliently connected to a connecting support 14 by two rubber buffers 9 and 10, said connecting support being in positive engagement by an internal thread with the upper part of the spindle 26, which runs counter to the lower part of the spindle 26. The result of this is that when the cable conveying unit is in use the conveying rollers 4*a*, 4*b* and 5*a*, 5*b* press against the cable 0 to be conveyed with a resilience preset by the resilient rubber buffers 9 and 10 and the adjustment position of the two slide carriages.

The cable feeding distance to be effected when this cable conveying unit is in use corresponds to an adjustable value which corresponds to the number of revolutions of each of the two electric motors 6 and 7 and is stored in control electronics connected to the two electric motors.

Since, in order to avoid complications when feeding cables by means of this cable conveying unit, all the conveying rollers 4*a*, 4*b*, 5*a* and 5*b* should be rotated precisely synchronously with one another despite the lack of a mechanical drive connection between the lower and the upper conveying roller pair, it is expedient if the two drive units 2 and 3 are driven by a respective electric motor 6 and 7 supplied by means of a current fed in pulsed form, and the cable feeding distance to be effected by means of this cable conveying unit corresponds to an adjustable digital pulse-number value which corresponds to the number of revolutions of each of these two electric motors 6 and 7 and is stored in control electronics connected to the two electric motors.

Figure 7:
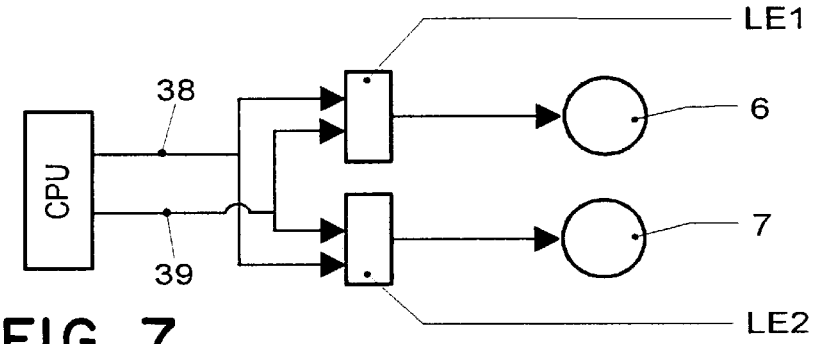
FIG. 7 shows diagrammatically the control of the two electric motors of a cable conveying unit according to FIGS. 1 to 6 when stepping motors are used.

A circuit arrangement which is suitable for this, is extremely simple, inexpensive and nevertheless has a very precise action is illustrated by way of example in FIG. 7, in which the two conveying roller drive motors 6 and 7 each consist of a stepping motor, said motors for their part being connected to a CPU by a respective power unit LE1 and LE2. In this arrangement, the signal associated with the sense of rotation of the drive motors 6 and 7 to be controlled is transmitted to the power units LE1 and LE2 by the line 38 and the pulse signal required for driving the stepping motors 6 and 7 is transmitted to the power units LE1 and LE2 by the line 39.

Figure 8:
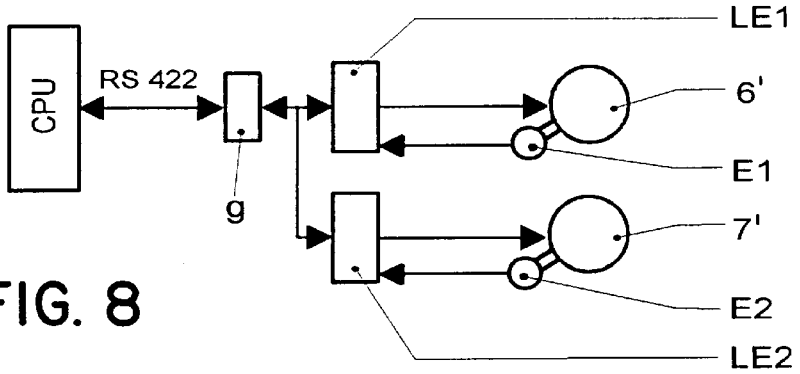
FIG. 8 shows diagrammatically the control of the two electric motors of a cable conveying unit according to FIGS. 1 to 6 when a.c. servomotors controlled by a rotary field are used.

Another exemplary embodiment of a circuit arrangement which is also suitable is illustrated in FIG. 8, according to which the two conveying roller drive motors 6' and 7' each consist of a brushless a.c. servomotor controlled by the rotary field, said motors for their part being connected to a central processing unit CPU by a respective power unit LE1 and LE2, a gateway (filter) g and an RS422 interface. The two a.c. servomotors 6' and 7' are connected to a respective encoder or resolver E1 and E2 and these latter to a respective evaluating circuit in the respective power unit LE1 and LE2, which continually compares the actual angle of rotation of the two electric motors 6' and 7', when they are in use, with a desired angle of rotation, and if a given tolerance limit is exceeded effects a correction in the current fed to the electric motor in question which reduces this deviation.

It is of course also possible to use d.c. servomotors as the conveying roller drive motors 6' and 7' in FIG. 8.

A conveying band pair may also be used to feed a cable 0 instead of the conveying roller pair 4*a*, 4*b*, 5*a* and 5*b* used in the above-described exemplary embodiment.

Figure 9:
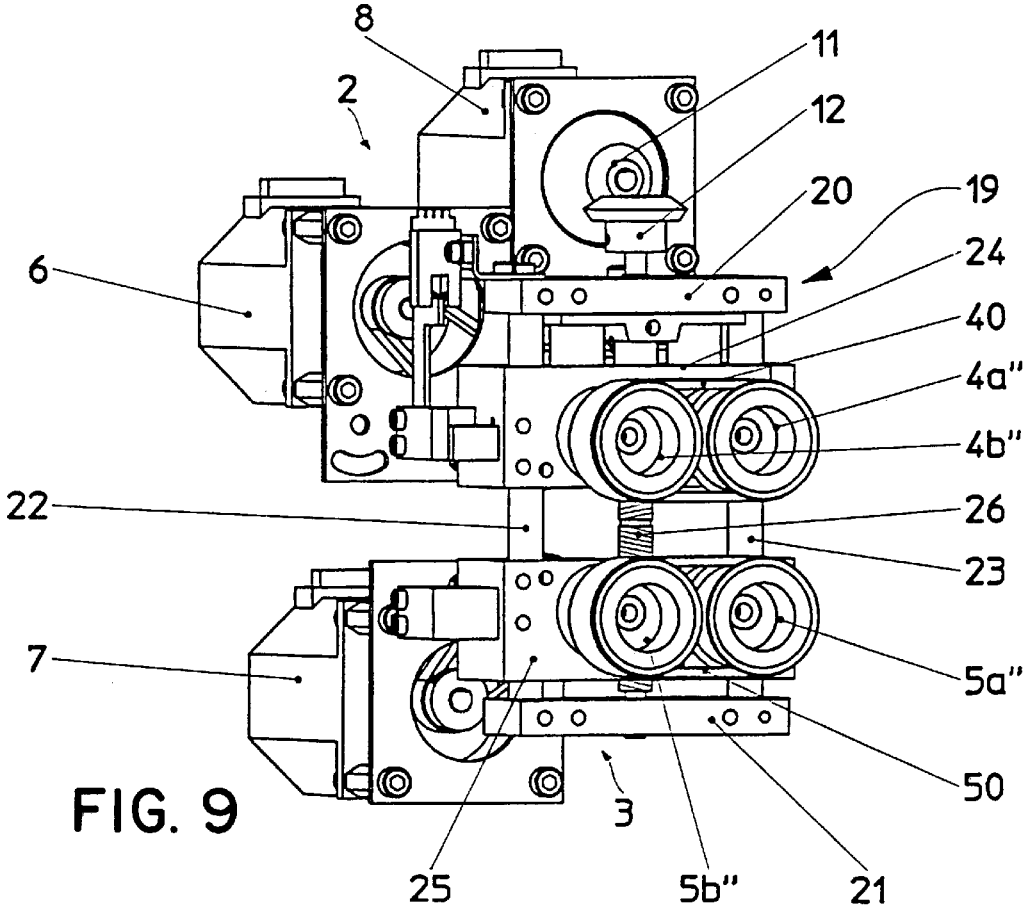
FIGS. 9 and 10 show perspective views analogous to FIGS. 5 and 6 of a second embodiment of a cable conveying unit according to the invention, provided with two conveying bands in place of the two conveying roller pairs.
Figure 10:
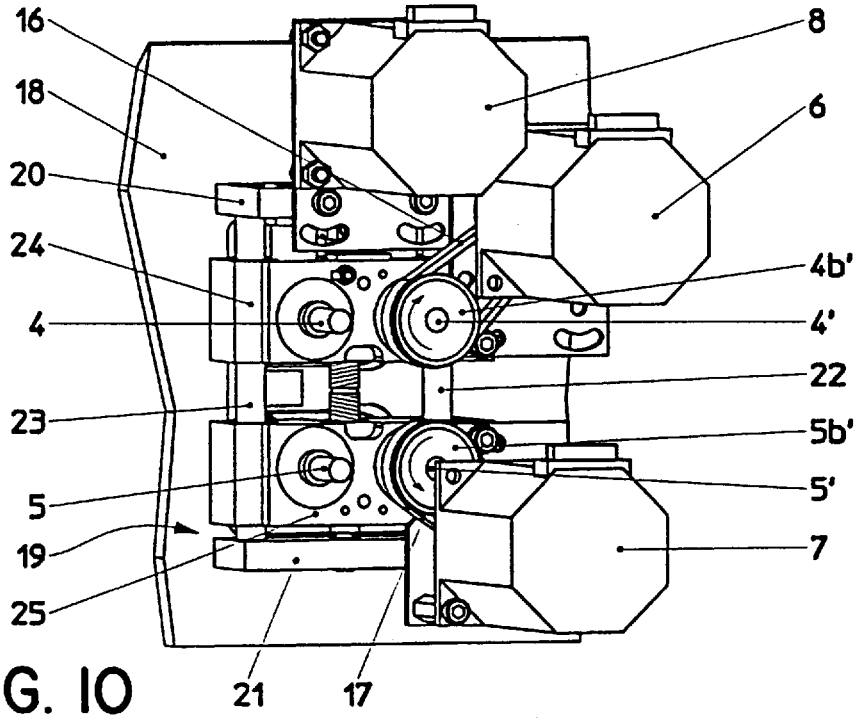
Figure 11:
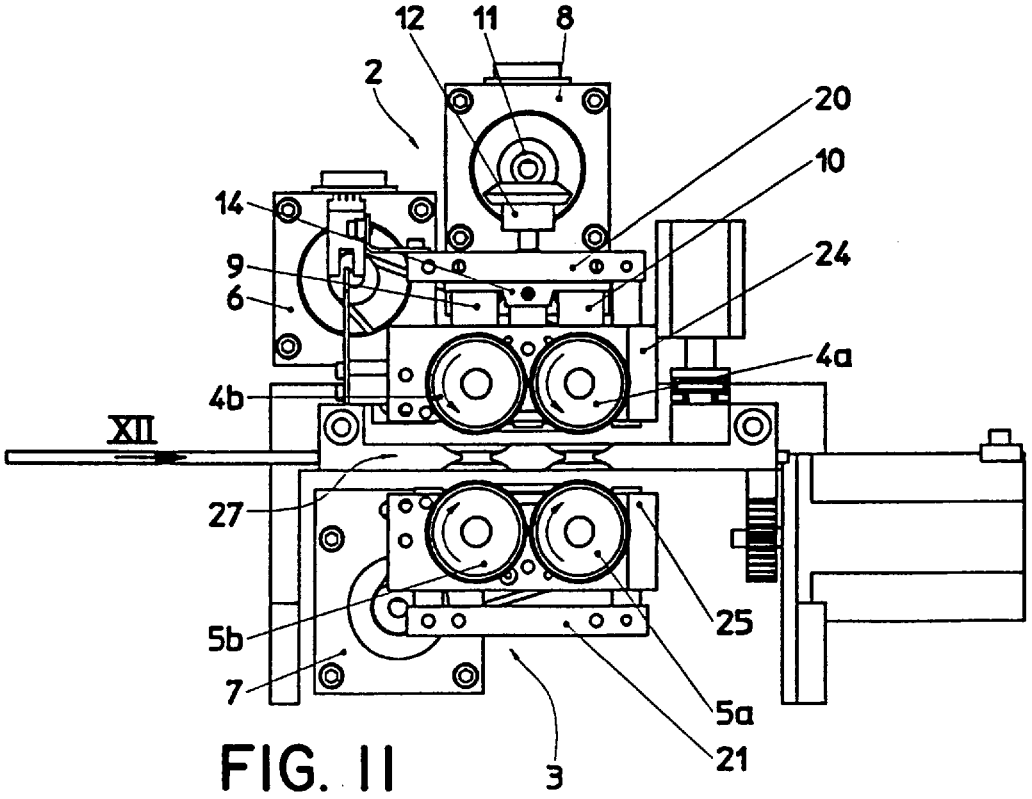
FIG. 11 shows a front view of a third exemplary embodiment of a cable conveying unit according to the invention, provided with a cable changer.
Figure 12:
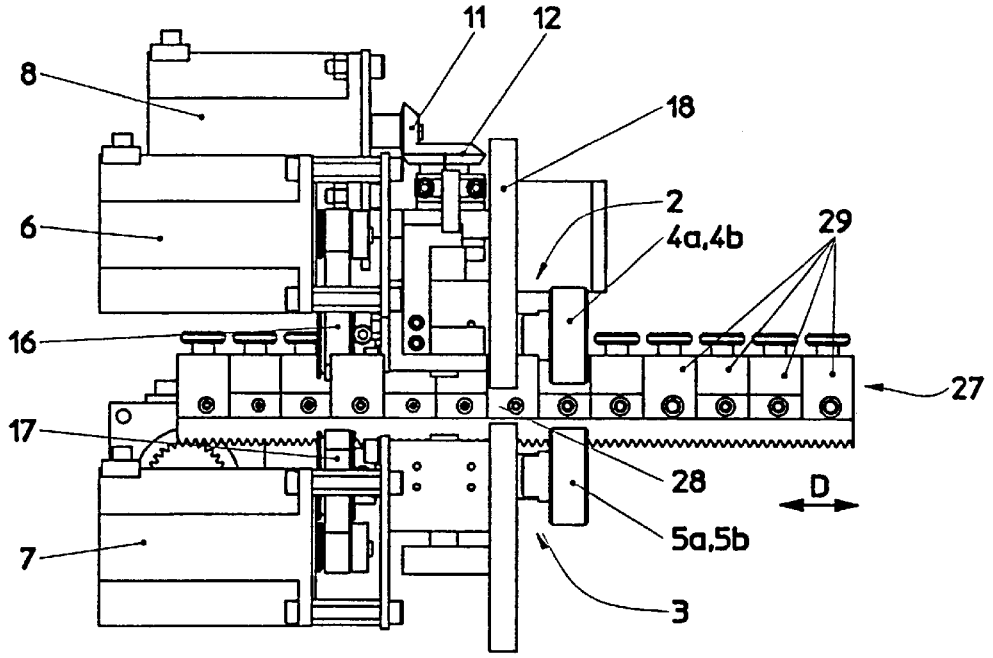
FIG. 12 shows a side view of the cable conveying unit illustrated in FIG. 11 in the direction of the arrow XII in FIG. 11.
Figure 13:
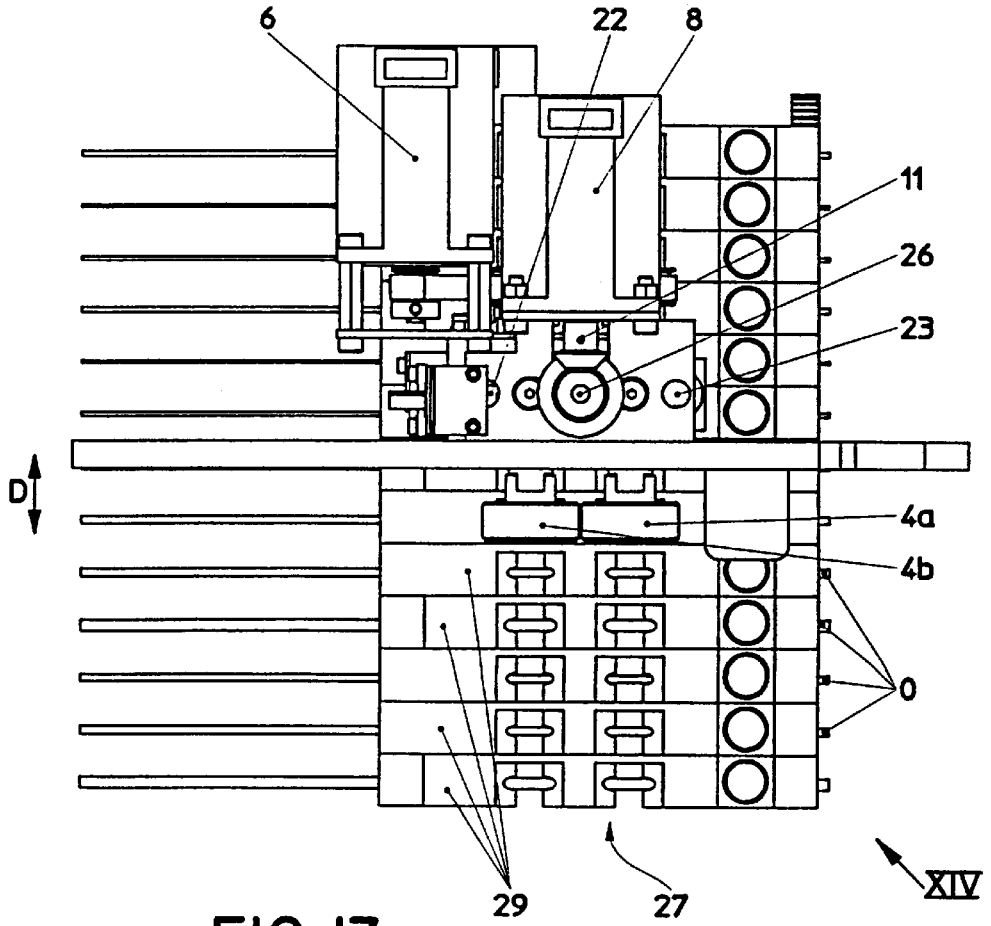
FIG. 13 shows a plan view of the cable conveying unit illustrated in FIG. 11.
Figure 14:
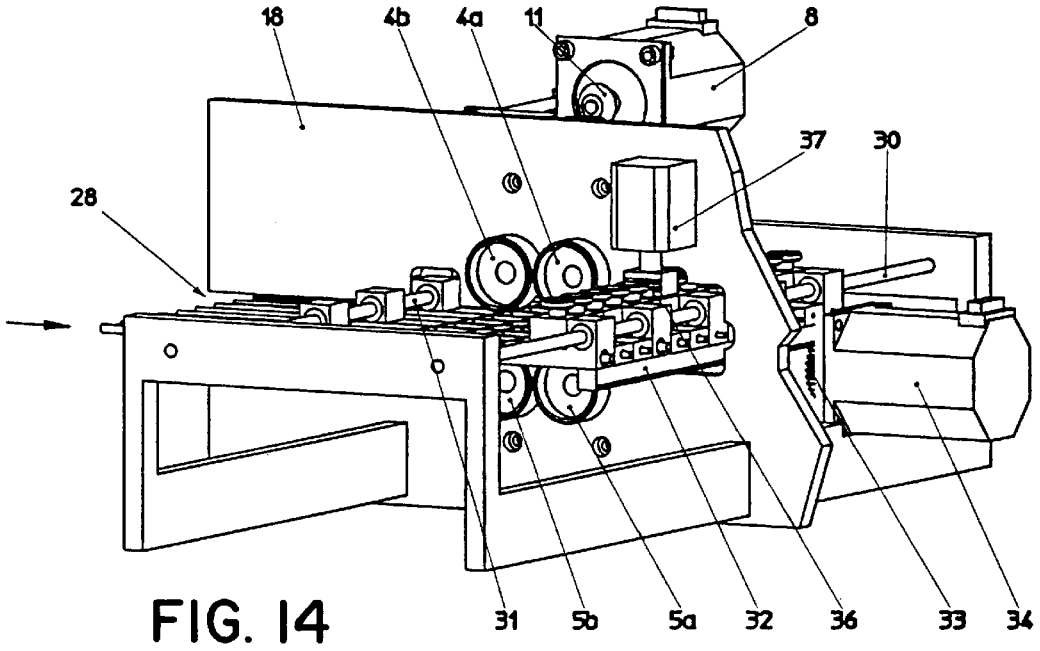
FIG. 14 shows a perspective front view of the cable conveying unit illustrated in FIGS. 11 to 13 in the direction of arrow XIV in FIG.13, mounted together with the drive of the cable changer in a frame provided with a fastening plate.
Figure 15:
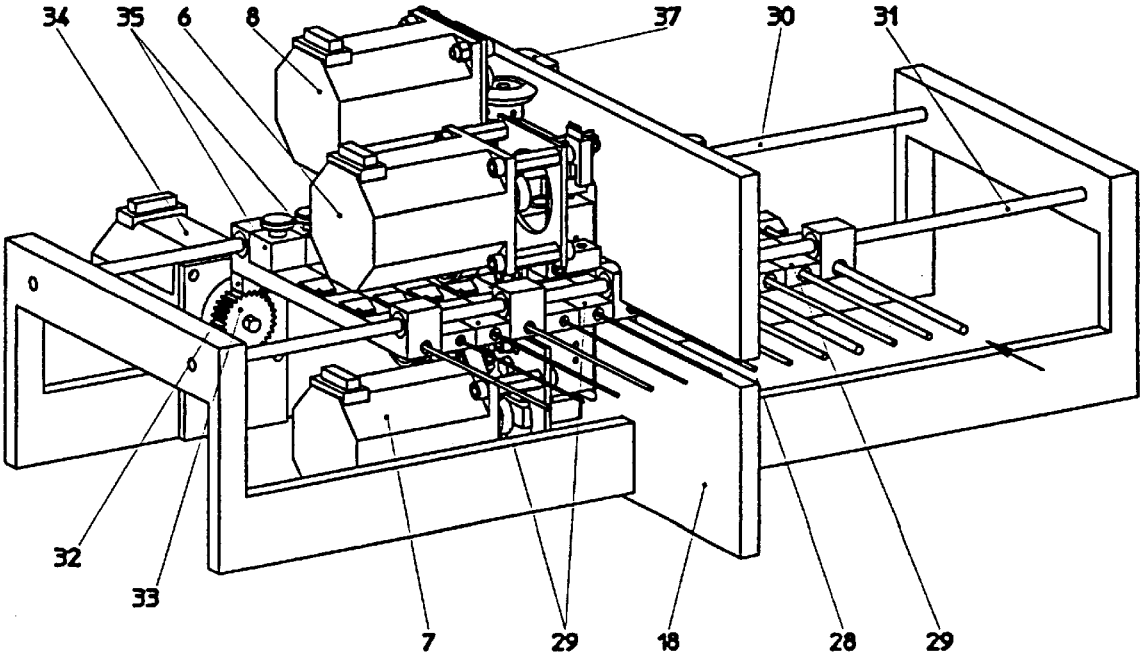
FIG. 15 shows a perspective rear view of the unit illustrated in FIG. 13.

For this purpose there are provided, as is apparent from FIGS. 9 and 10, per drive unit 2 and 3, two respective band guiding rollers 4*a*", 4*b*" and 5*a*", 5*b*" which are rotatably mounted one beside the other, are toothed on their outer circumference in the region which receives the conveying band and are connected to one another in pairs in terms of drive by a respective common conveying band 40 and 50 designed as a toothed belt. On the rear side each one of the band guiding rollers 4*b*" and 5*b*" is connected in terms of drive to the respective associated drive motor 6 and 7 by a respective toothed drive wheel 4*b*' and 5*b* and a respective toothed drive belt 16 and 17.

The remaining parts are analogous to the first exemplary embodiment.

A further cable conveying unit according to the invention, combined with a cable changer serving for the conveyance of different cables 0, is described in more detail below with reference to FIGS. 11 to 15, with the exception of the parts already described in more detail above with reference to the first exemplary embodiment.

Owing to the provision of a cable changer 27 for the guided holding of a plurality of different cables 0, which is displaceable in the direction of the arrow D (see FIGS. 12 and 13) perpendicularly to the direction of the cable passing through, the provision of a guiding and fastening frame 19 as in the first exemplary embodiment described hereinabove is not possible, since its vertical guides 22, 23 and the spindle 26 provided with a left-hand and a right-hand thread would impede such a displaceability of a cable changer.

Instead, in this embodiment of a cable conveying unit combined with a cable changer 27 the two drive units 2 and 3 are screwed directly to the fastening plate 18, which is provided with an aperture 28 intended for the cable changer 27, by the upper and lower fastening support 20 and 21 respectively.

The cable changer 27 has a plurality of cable guiding elements 29 which run parallel to one another and are screwed to one another laterally to form a slide which is displaceable along the guides 30 and 31. For its lateral displacement this slide is provided with a downwardly directed toothed rack 32 which is in engagement with the drive pinion 33 of an adjusting motor 34.

In order to ensure a constant positioning of the cables 0 situated in the individual cable guiding elements 29 even during a lateral displacement D of the cable changer 27, there are provided, at least at the front outlet end of the individual cable guiding elements 29, cable clamping elements 35 which are under spring pressure and firmly hold in a clamping manner the cables 0 extending through the latter.

If the cable guiding elements 29 are relatively long, it is also possible to provide at the rear inlet end of the individual cable guiding elements 29 a respective further cable clamping element in order to avoid sagging of the cable section situated in said cable guiding elements.

When this cable conveying unit combined with a cable changer 27 is in use, immediately before the conveying rollers 4*a*, 4*b*, 5*a*, 5*b* engage with the cable 0 to be conveyed the cable clamping element 35 associated with the corresponding cable guiding element 29 is released by means of a lifting element 37 which can be brought releasably into engagement with a pull knob 36 of said cable clamping element, so that the cable 0 to be conveyed can be moved in its longitudinal direction without being hindered.

We claim the following:

1. A cable conveying unit for a precise feeding of a given length of a cable into a cable processing station, said unit comprising:

two drive units;

at least two conveying rollers or bands each carried by a respective drive unit and separated from one another by a space that defines a cable conveying path and arranged to be placed against the outside of the cable;

two speed-controlled electric motors each connected to individually drive a respective one of said rollers or bands, wherein each roller or band is driven solely by a respective one of said motors;

control electronics coupled to each motor for driving each motor by an angular amount corresponding to a desired cable feed distance and for driving each motor at a controlled speed which causes said rollers or bands to displace the cable by the desired feed distance;

an adjusting drive mounted for displacement in a direction transverse to the cable conveying path;

resilient means coupled between said adjusting drive and one of said drive units such that said one of said drive units is resiliently supported by said adjusting drive; and an adjusting motor coupled to said adjusting drive for displacing said adjusting drive in the direction transverse to the cable conveying path and relative to the other one of said drive units to an adjustment position for precisely adjusting said one of said drive units relative to said other one of said drive units such that when said rollers or bands are placed against the cable, said rollers or bands press against the cable with a resilience preset by said resilient means and the adjustment position.

2. A cable conveying unit as claimed in claim 1, wherein the two electric motors are reversible in their direction of rotation in order to effect a return movement of the cable by a given amount from a previously effected feed position.

3. A cable conveying unit as claimed in claim 1, wherein at least one of the two drive units is adjustable precisely with respect to the other drive unit toward and away therefrom and said adjusting motor is a stepping motor.

4. A cable conveying unit as claimed in claim 1, wherein each of the two drive units has a respective common drive belt and has two respective conveying rollers which are rotatably mounted one beside the other and which, per drive unit, are connected in terms of drive to the respective associated electric motor by said respective common drive belt.

5. A cable conveying unit as claimed in claim 1, wherein each of the two drive units has a respective common conveying band and has at least two respective band guiding rollers which are rotatably mounted one beside the other and which, per drive unit, are connected in terms of drive to the respective associated electric motor by said respective common conveying band.

6. A cable conveying unit as claimed in claim 1, wherein the two electric motors are stepping motors.

7. A cable conveying unit as claimed in claim 1, wherein the two electric motors are servomotors, and said unit further comprises an evaluating circuit which is connected to a respective encoder or resolver of said two electric motors and which, when the two electric motors are in use, continually compares the actual angle of rotation of each of said electric motors with a desired angle of rotation, and if a given tolerance limit is exceeded effects a correction in the current fed to one of said electric motors which reduces this deviation.

8. A cable conveying unit as claimed in claim 1, wherein said control electronics drive each of said motors with current pulses and supply each said motor with an adjustable number of current pulses corresponding to the angular amount by which each said motor is to be driven.

9. A cable conveying unit as claimed in claim 1, wherein said two electric motors are driven to rotate counter to one another.

10. A cable conveying unit for feeding a given length of a cable along a conveying path to a processing station, said unit comprising:

first and second drive units separated from one another by a space through which the conveying path extends;

first conveying means carried by said first drive unit and second conveying means carried by said second drive unit and being mechanically de-coupled from said first conveying means, each of said drive units being positionable for placing said first and second conveying means against the cable and each of said conveying means being movable for feeding the cable along the conveying path;

two electric motors each connected exclusively to a respective one of said conveying means for imparting motion to the respective one of said conveying means;

control electronics coupled to each of said motors for rotating said motors by an angular amount and speed which causes said conveying means to act on the cable in synchronism so that said first conveying means acts to feed the cable at the same speed and by the same distance as said second conveying means;

adjustment means for an adjustment distance between said first and second drive units in a direction transverse to the conveying path, said adjustment means comprising a resilient member supporting one of said drive units, for pressing said conveying means against the cable with a resilience determined by said resilient member and the adjustment distance set by said adjustment means.

* * * * *